US008147015B2

(12) United States Patent
Kim et al.

(10) Patent No.: US 8,147,015 B2
(45) Date of Patent: Apr. 3, 2012

(54) HINGE ASSEMBLY AND REFRIGERATOR HAVING THE SAME

(75) Inventors: Dong-Jeong Kim, Seoul (KR); Wook-Yong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 275 days.

(21) Appl. No.: 12/547,620

(22) Filed: Aug. 26, 2009

(65) Prior Publication Data

US 2010/0154457 A1 Jun. 24, 2010

(30) Foreign Application Priority Data

Dec. 18, 2008 (KR) ..... 10-2008-0129584

(51) Int. Cl.

| | |
|---|---|
| ***E05D 1/06*** | (2006.01) |
| ***E05D 5/06*** | (2006.01) |
| ***A47B 96/04*** | (2006.01) |
| ***A47B 88/00*** | (2006.01) |

(52) U.S. Cl. ..... 312/405; 16/268; 16/262; 16/389; 312/329

(58) Field of Classification Search ..... 312/321.5, 312/405.1, 296, 326, 329, 292, 242, 245, 312/401, 405; 16/267, 268, 262, 389, 387, 16/270; 49/381, 398, 399

See application file for complete search history.

(56) References Cited

U.S. PATENT DOCUMENTS

| | | | | | |
|---|---|---|---|---|---|
| 1,257,572 | A | * | 2/1918 | Appleby | 16/266 |
| 1,340,151 | A | * | 5/1920 | Bump | 16/374 |
| 1,385,800 | A | * | 7/1921 | Soss | 16/270 |
| 1,927,398 | A | * | 9/1933 | Glasser | 62/377 |
| 2,027,724 | A | * | 1/1936 | Etzel | 49/398 |
| 2,129,923 | A | * | 9/1938 | Frankel | 312/236 |
| 2,135,878 | A | * | 11/1938 | Sekyra, Sr. | 62/252 |
| 2,150,064 | A | * | 3/1939 | John et al. | 62/266 |
| 2,209,659 | A | * | 7/1940 | Mercer | 16/261 |
| 2,795,472 | A | * | 6/1957 | Sutherland | 312/400 |
| 3,353,884 | A | * | 11/1967 | Chaffee et al. | 312/199 |
| 3,603,657 | A | * | 9/1971 | Hassay | 312/404 |
| 3,822,925 | A | * | 7/1974 | Osroff | 312/242 |
| 4,177,540 | A | * | 12/1979 | Gorton | 16/335 |
| 4,955,676 | A | * | 9/1990 | Weaver et al. | 312/407 |

(Continued)

FOREIGN PATENT DOCUMENTS

DE 1276666 * 9/1968

(Continued)

OTHER PUBLICATIONS

Written Opinion and International Search Report dated Sep. 8, 2009.

*Primary Examiner* — Darnell Jayne

*Assistant Examiner* — Andrew Roersma

(74) *Attorney, Agent, or Firm* — KED & Associates, LLP

(57) ABSTRACT

An insertion-type hinge assembly may include a first hinge member including a mount unit and a shaft that is separated from and coupled to the mount unit, and that is positioned in parallel to the mount unit. The hinge assembly also includes a second hinge member that receives the shaft therein so as to rotatably couple the first and second hinge members. The first and second hinge members may be installed in corresponding recesses of a door and a main body such that they are not exposed.

16 Claims, 13 Drawing Sheets

U.S. PATENT DOCUMENTS

| | | | | |
|---|---|---|---|---|
| 4,979,264 | A * | 12/1990 | Ramsauer | 16/264 |
| 5,085,491 | A * | 2/1992 | Lautenschlager | 312/329 |
| 5,193,892 | A * | 3/1993 | Swindell | 312/405.1 |
| 5,232,277 | A * | 8/1993 | Cassady et al. | 312/296 |
| 5,271,671 | A * | 12/1993 | Mandel | 312/405 |
| 5,419,085 | A * | 5/1995 | Imbur | 49/398 |
| 5,564,775 | A * | 10/1996 | Ebert et al. | 296/202 |
| 5,564,808 | A * | 10/1996 | Gipson et al. | 312/405 |
| 6,085,542 | A * | 7/2000 | Johnson et al. | 62/441 |
| 6,314,616 | B1 * | 11/2001 | King | 16/382 |
| 6,434,791 | B1 * | 8/2002 | Chung | 16/387 |
| 2004/0119384 | A1 * | 6/2004 | Davis et al. | 312/223.2 |
| 2004/0160149 | A1 * | 8/2004 | Chen | 312/223.2 |
| 2004/0189164 | A1 * | 9/2004 | Hwang | 312/405 |
| 2005/0218766 | A1 * | 10/2005 | Hwang | 312/405 |
| 2006/0196214 | A1 * | 9/2006 | Lee et al. | 62/344 |
| 2007/0130726 | A1 * | 6/2007 | Alfredsson et al. | 16/267 |

FOREIGN PATENT DOCUMENTS

| | | |
|---|---|---|
| EP | 1030139 | 8/2000 |
| KR | 10-1996-0018491 | 6/1996 |
| KR | 20-0117763 | 7/1998 |

* cited by examiner

HINGE ASSEMBLY AND REFRIGERATOR HAVING THE SAME

CROSS-REFERENCE TO RELATED APPLICATIONS

This claims priority to Korean Application No. 10-2008-0129584, filed in Korea on Dec. 18, 2008, the entirety of which is incorporated herein by reference.

BACKGROUND

1. Field

A hinge assembly and a refrigerator having the same is provided and, more particularly, a hinge assembly installed at a front side of an opening of a refrigerator is provided.

2. Background

Refrigerators are appliances that store fresh food items. A refrigerator may include main body having a cooling chamber formed therein, doors for opening and closing the cooling chamber, and a refrigerating cycle device for providing cold air to the cooling chamber. The refrigerating cycle device may be, for example, a vapor compression refrigerating cycle device including a compressor for compressing a refrigerant, a condenser for releasing heat to condense the refrigerant, an expansion device for reducing the pressure of the refrigerant and expanding the refrigerant, and an evaporator for allowing the refrigerant to absorb ambient heat so as to be evaporated.

In order to enhance user convenience and satisfaction, the refrigerator may include various features and functions. For example, the refrigerator may include an ice making system for making and dispensing ice cubes. Such an ice making system may include an ice maker for making ice cubes, and an ice bank positioned at a lower side of the ice maker to store ice cubes made by the ice maker. It would further enhance user convenience and satisfaction if a size of components related to the ice making system were minimized so as to maximize usable storage space within the refrigerator.

BRIEF DESCRIPTION OF THE DRAWINGS

The embodiments will be described in detail with reference to the following drawings in which like reference numerals refer to like elements wherein.

DETAILED DESCRIPTION

An ice maker for a refrigerator may be mounted at an inner side of one of the doors that open/close a cooling chamber of the refrigerator, or within a freezing chamber. In addition, a separate ice making chamber may be formed within the door, or within a freezing chamber, to accommodate the ice maker. Such an ice making chamber may include an ice making chamber door to open or close an open face of the ice making chamber. A main door hinge and an ice making chamber door hinge, which rotatably support the main door and the ice making chamber door, respectively, may be provided at upper and lower regions of the main door that opens and closes the cooling chamber of the refrigerator and the ice making chamber door that opens and closes the ice making chamber, respectively.

However, if the main door hinge and/or the ice making chamber door hinge protrude from the upper end of the refrigerator main body and/or the upper end of the ice making chamber door, the hinges may interfere with peripheral components that may be installed flush to the main body.

In addition, when both the main door and the ice making chamber door are open, a portion of a gasket near the main door hinge and the ice making door hinge may be unnecessarily pressed, and may be easily deformed and damaged due to the repeated opening and closing, thus degrading the sealing capability of the gasket.

Figure 1:
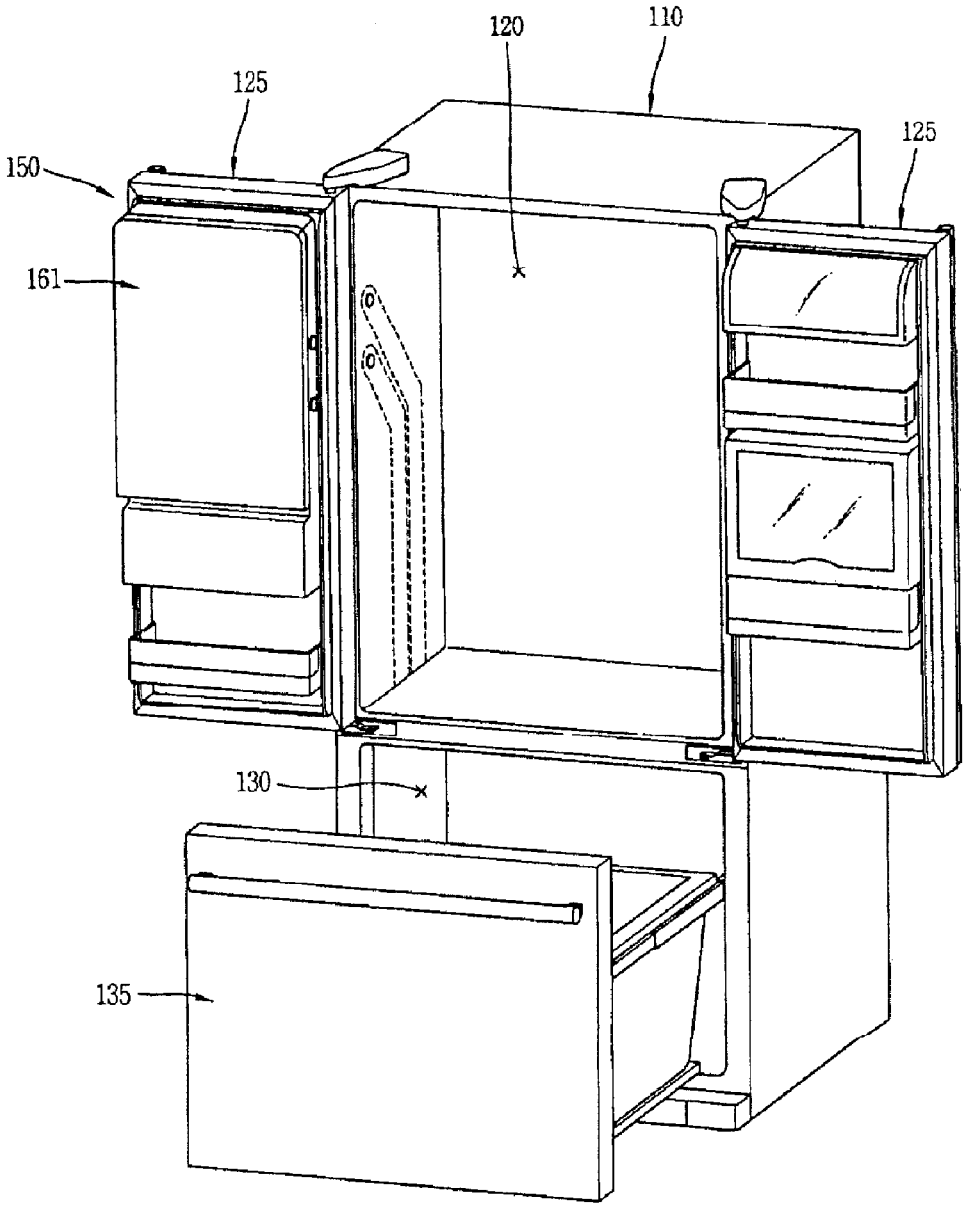
FIG. 1 is a perspective view of a refrigerator having an insertion-type hinge assembly according to one embodiment as broadly described herein.
Figure 2:
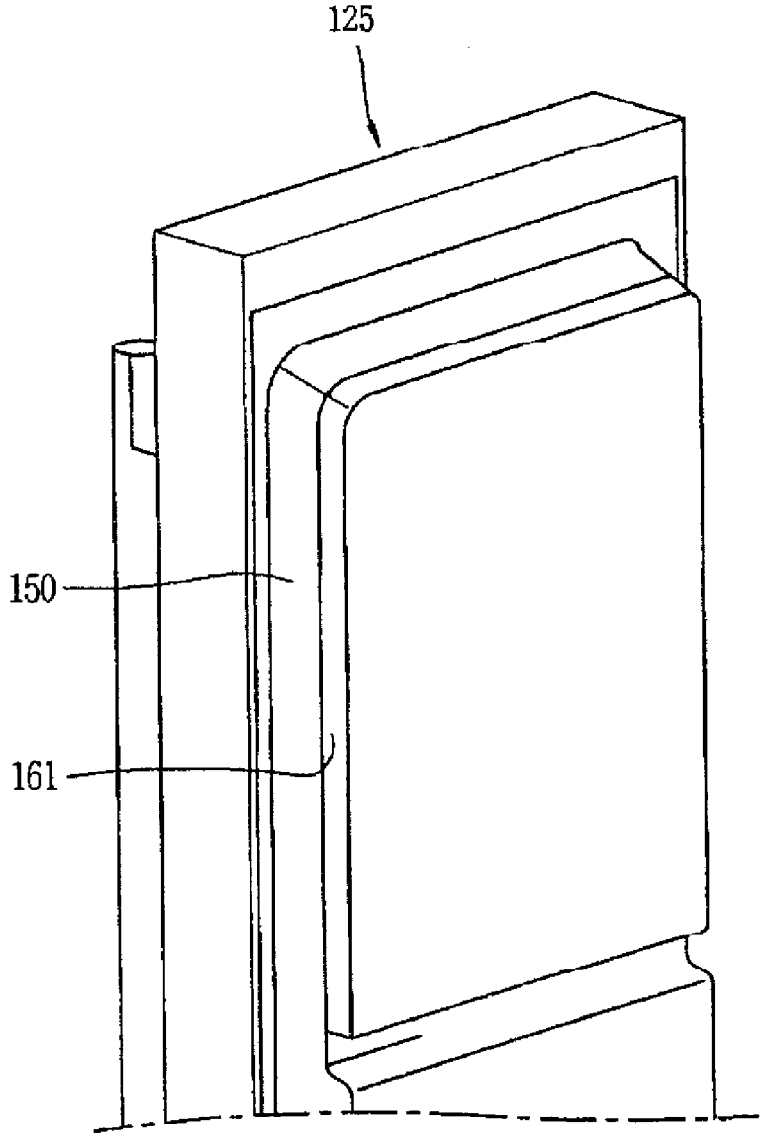
FIG. 2 is an enlarged perspective view of an ice making chamber door region shown in FIG. 1.
Figure 3:
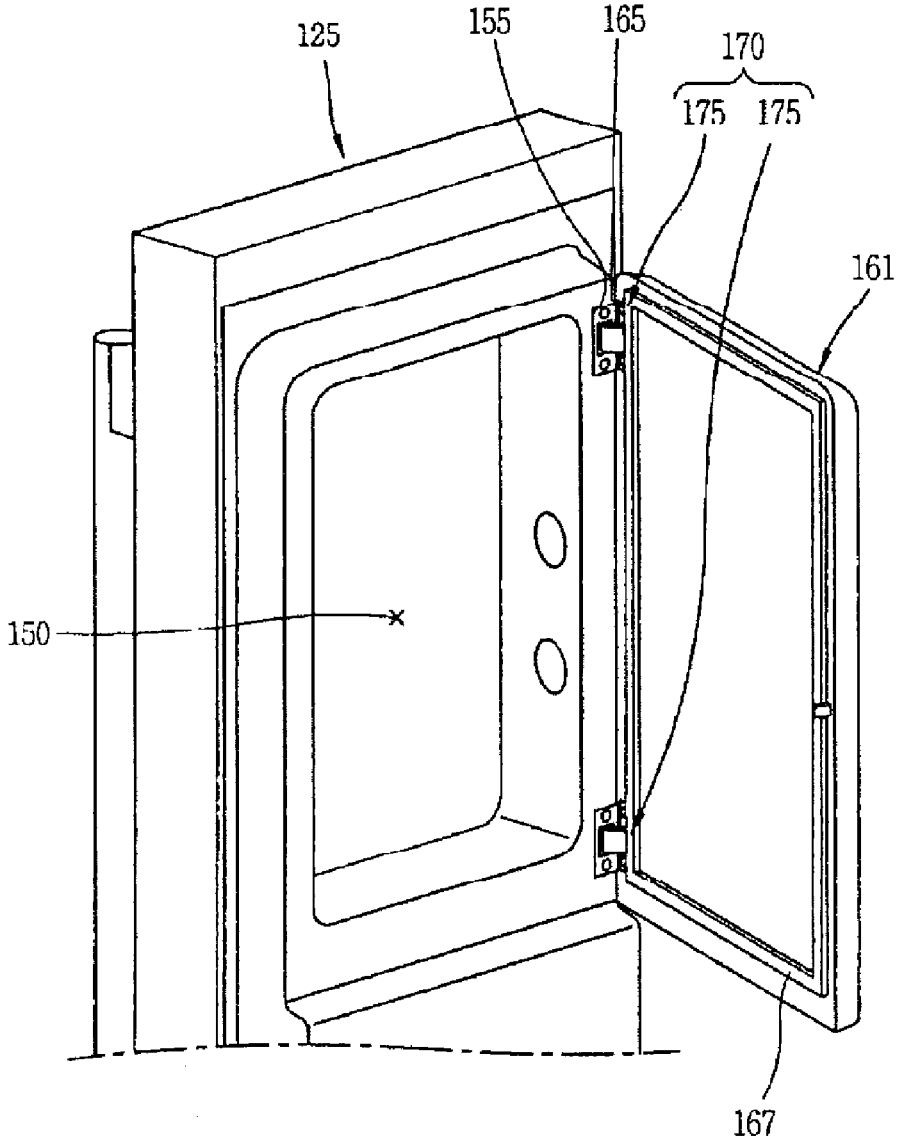
FIG. 3 is a perspective view showing an open state of the ice making chamber door shown in FIG. 2.

The exemplary refrigerator shown in FIG. 1 may include a refrigerator main body 110 having a cooling chamber formed therein, one or more doors for opening and closing a front opening of the cooling chamber, an ice making chamber 150 formed at one of either the refrigerator main body 110 or one of the doors, an ice making chamber door 161 for opening and closing an opening of the ice making chamber 150, and an ice making chamber door hinge 170 including at least one insertion-type hinge assembly 175 to rotatably support the ice making chamber door 161 relative to the ice making chamber 150.

In this instance, the cooling chamber may collectively refer to a refrigerating chamber and a freezing chamber. In alternative embodiments, the refrigerator main body may include only one of the refrigerating chamber or the freezing chamber. In the following description, for ease of discussion, it is assumed that the refrigerator main body includes a freezing chamber and a refrigerating chamber.

In particular, in the embodiment shown in FIG. 1, a refrigerating chamber 120 may be formed at an upper region of the refrigerator main body 110, and a freezing chamber 130 may be formed at a lower region of the refrigerator main body 110. The freezing chamber 130 may include a drawer type refrigerating chamber door 135 that slidably opens and closes the freezing chamber 130. A vapor compression type refrigerating cycle (not shown) may provide cold air to the refrigerating chamber 120 and the freezing chamber 130. A pair of refrigerating chamber doors 125 may be provided at the front side of the refrigerating chamber 120 to selectively open and close the refrigerating chamber 120. Alternatively, the refrigerating chamber 120 may be opened and closed by a single door.

An ice making chamber 150 may be provided at one of either the refrigerator main body 110 or the refrigerating chamber door 125. A case in which the ice making chamber 150 is formed at the left refrigerating chamber door 125, as shown in FIG. 1, will now be described.

The ice making chamber 150 may be formed at an upper region of the inner side of the refrigerating chamber door 125, with the ice making chamber 150 open to the interior side, facing the refrigerating chamber 120. The ice making chamber 150 may include an ice making chamber door 161 to open and close the open side of the ice making chamber 150 facing the refrigerating chamber 120.

An insertion-type hinge assembly 175 may be provided at a mutual contact region where the ice making chamber 150 and the ice making chamber door 161 contact each other, in order to rotatably support the ice making chamber door 161. The insertion-type hinge assembly 175 may be installed at a plurality of regions, including the upper region of the mutual contact region of the ice making chamber 150 and the ice making chamber door 161. For example, in this embodiment, the ice making chamber door hinge 170 includes insertion-type hinge assemblies 175 installed at upper and lower portions of the ice making chamber 150 and the ice making chamber door 161.

Hinge accommodating parts 155 and 165 may be formed at the upper and lower regions of the mutual contact region of the ice making chamber 150 and the ice making chamber door 161 to accommodate the insertion-type hinge assemblies 175, respectively. An ice making chamber door gasket 167 may be installed at an inner side of the ice making chamber door 161 to form a seal so that cold air does not leak out of the ice making chamber 150 when the ice making chamber door 161 is closed against the open front face of the ice making chamber 150.

The ice making chamber door gasket 167 may be installed along outer edges of the ice making chamber door 161. The hinge accommodating parts 165 of the ice making chamber door 161 may be formed at an outer side of the ice making chamber door gasket 167. Thus, when the ice making chamber door 161 is open or closed, the ice making chamber door gasket 167 is not heavily pressed and deformed or damaged due to contact with the hinge 170. Additionally, the ice making chamber door gasket 167 may contact the front side of the ice making chamber 150 and may be elastically deformed only when the ice making chamber door 161 is completely closed. When the ice making chamber door 161 is open, the ice making chamber door gasket 167 is separated from the front opening of the ice making chamber 150, so it is not heavily pressed and deformed or damaged when the ice making chamber door 161 is open or closed.

The insertion-type hinge assembly will now be described with reference to FIGS. 4 to 12.

As shown in FIGS. 4 to 7, the insertion-type hinge assembly 175 may include a first hinge member 180 including a mount unit 182 that may be fixed to a first installation area, and a shaft 184 spaced apart from the mount unit 182 and oriented in parallel to the mount unit 182. The hinge assembly 175 may also include a second hinge member 200 that may be fixed to a second installation area, and that rotatably receives the shaft 184 therein. The first and second hinge members 180 and 200 may be inserted into their corresponding installation areas such that they are only minimally visible.

Figure 5:
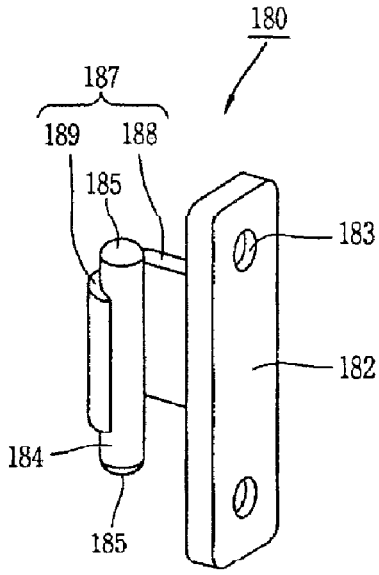
FIG. 5 is a perspective view of a first hinge member shown in FIG. 4.

As shown in FIG. 5, the mount unit 182 of the first hinge member 180 may be inserted into a portion of the ice making chamber door 161, with the shaft 184 spaced apart from the mount unit 182 and disposed in parallel to the mount unit 182. A connection unit 187 may extend out from the mount unit 182 so as to support the shaft 184. The mount unit 182 may have a substantially rectangular plate shape. The mount unit 182 may be inserted into the first installation area, namely, into the hinge accommodating part 165 formed in the ice making chamber door 161. Coupling holes 183 that penetrate the mount unit 182 allow a fastening member (not shown) such as, for example, a screw to extend therethrough and into the hinge accommodating part 165.

Figure 8:
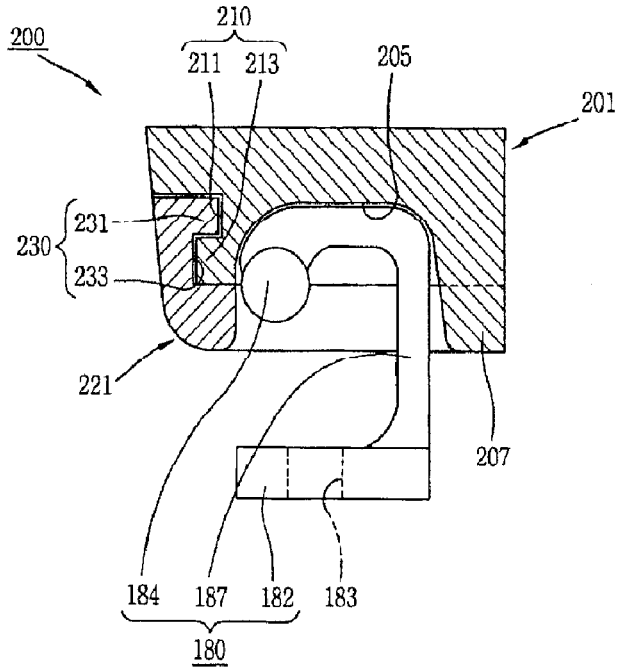
FIG. 8 is a sectional view taken along line VIII-VIII of FIG. 4.

With reference to FIG. 8, the connection unit 187 may protrude from a longer side of the mount unit 182 at a substantially right angle, from a substantially central region of the mount unit 182. The connection unit 187 may include a protrusive portion 188 that protrudes at a right angle from the mount unit 182, and a bent portion 189 that extends at a substantially rounded right angle from an end portion of the protrusive portion 188. The shaft 184 may be connected to an end portion of the bent portion 189, with its end portion surrounding a certain portion of the shaft 184.

Figure 10:
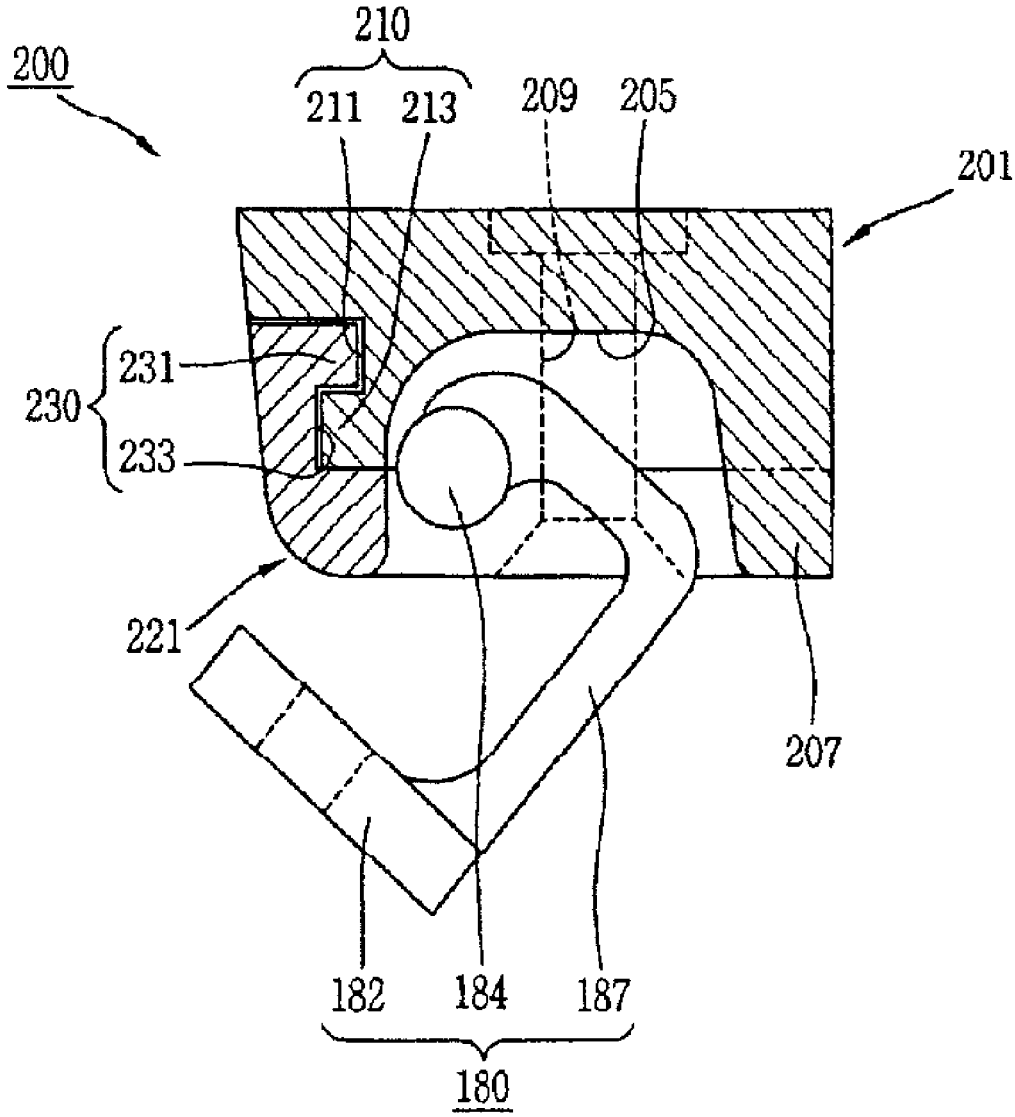
FIG. 10 illustrates an operation of the hinge assembly shown in FIG. 4.

As shown in FIG. 10, the protrusion length of the protrusive portion 188 may be properly adjusted in consideration of the thickness and an elastic deformation degree of the ice making chamber door gasket 167.

The shaft 184 may protrude from both ends of the bent portion 189. Round portions 185 may be formed at both ends of the shaft 184. Both end portions of the shaft 184 may include a chamfer portion (not shown) formed at an incline in an axial direction and extending along a circumferential direction of the end portions of the shaft 184.

Figure 4:
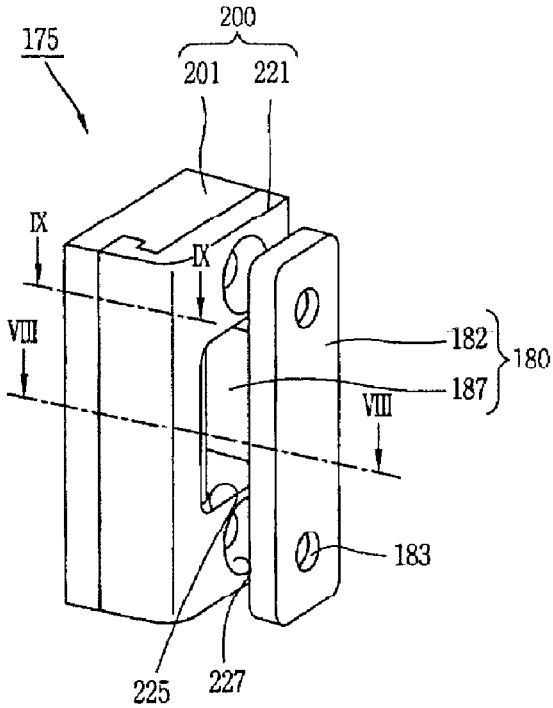
FIG. 4 is a perspective view of an insertion-type hinge assembly shown in FIG. 3.

As shown in FIG. 4, the second hinge member 200 may include a body 201 having a partial shaft accommodating part 203 for accommodating a portion of the shaft 184, and a cover 221 having a partial shaft accommodating part 223 for accommodating the remaining portion of the shaft 184, the cover 221 having surface-contact with the body 201.

Figure 6:
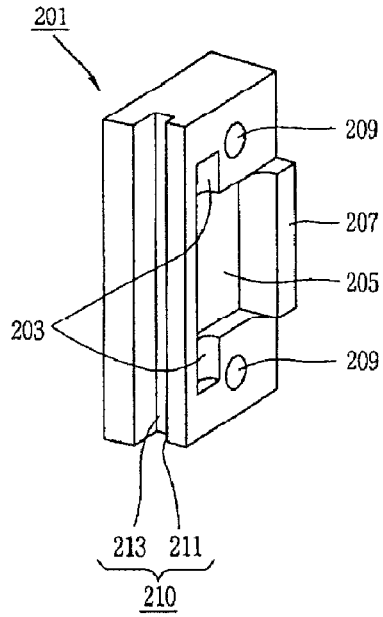
FIG. 6 is a perspective view of a body of a second hinge member shown in FIG. 4.
Figure 7:
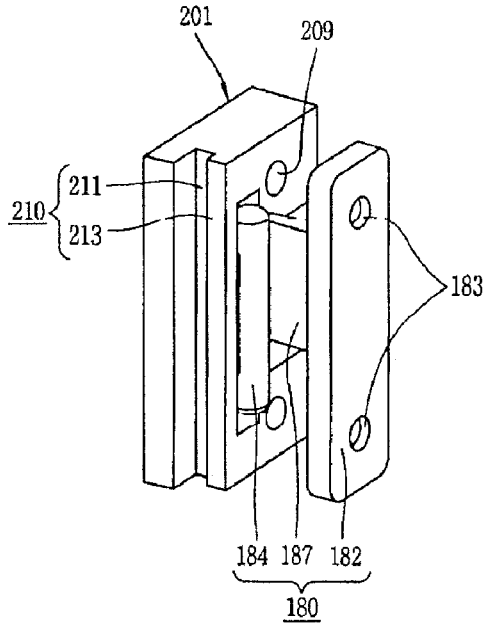
FIG. 7 is a perspective view of the hinge assembly shown in FIG. 4, without a cover.

With reference to FIG. 6, the body 201 may have a substantially rectangular shape. The partial shaft accommodating part 203 may be formed as a recess in one surface of the body 201 to accommodate the shaft 184. A connection unit accommodating part 205 may be formed as a recess at a central region of the partial shaft accommodating part 203 such that it corresponds to the width of the connection unit 187 to accommodate the connection unit 187 therein. The connection unit accommodating part 205 may be deeper and wider compared to the partial shaft accommodating part 203.

A stopper 207 may be formed at one side of the connection unit accommodating part 205. The stopper 207 may contact the connection unit 187 to limit rotation of the connection unit 187. Accordingly, a rotation range of the first hinge member 180 may be limited, and the ice making chamber door 161 may be prevented from colliding with the front side of the ice making chamber 150. The stopper 207 may protrude from the surface of the body 201.

One or more insertion holes 209 may be formed on the body 201 to allow a fastening member such as, for example, a screw to be inserted therethrough and into the hinge accommodating part 155 of the ice making chamber 150. A female threaded portion (not shown) may be formed on the body 201 to allow the screw or the like which has passed through the cover 221 to be combined therein. The number of insertion holes 209 may be appropriately adjusted.

A cover coupling unit 210 may be formed at one side of the body 201, and in particular, at the side opposite the stopper 207, to allow the cover 221 to be engaged therein, thus reducing a number of screws required to fix the body 201 to the cover 221. The cover coupling unit 210 may include a recess 213 and a protrusion stop 211 formed along a longer side portion of the body 201 in the lengthwise direction, as shown in FIG. 6.

As shown in FIG. 4, the cover 221 may have a substantially rectangular plate shape corresponding to the configuration of the body 201. The cover 221 may include a penetrating portion 225 formed therein to receive the connection unit 187.

Figure 9:
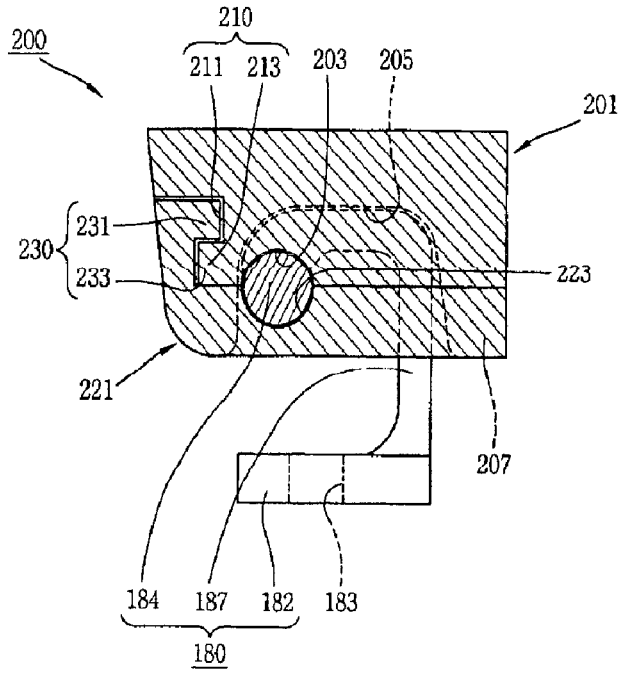
FIG. 9 is a sectional view taken along line IX-IX of FIG. 4.

With reference to FIG. 9, the partial shaft accommodating part 223 may be formed as a recess to partially accommodate the shaft 184. Both end portions of the partial shaft accommodating parts 203 and 223 of the body 201 and the cover 221, respectively, may be rounded to correspond to the shape of the round portion 185 of the end portions of the shaft 184. Accordingly, the shaft 184 may be rotatably supported in a radial direction and in an axial direction.

The cover 221 may include a coupling hole 227 that receives a fastening member such as, for example, a screw from the insertion hole 209 of the body 201. A body coupling unit 230 may be formed at one side, specifically, at a longer side portion, of the cover 221 so as to engage the cover coupling unit 210 of the body 201. The body coupling unit 230 may include a protrusion stop 231 and a recess 233 disposed in parallel to the cover 221. Namely, the protrusion stop 231 of the cover 221 may be inserted into the recess 213 of the body 201, and the protrusion stop 211 of the body 201 may be inserted into the recess 233 of the cover 221, so as to engage the body 201 and the cover 221 and prevent separation.

To combine the body 201 and the cover 221, first, the shaft 184 (which is held by the connection unit 184 of the first hinge member 180) is inserted into the penetrating portion 225 of the cover 221, with the shaft 184 accommodated in the partial shaft accommodating part 203 of the body 201, and the body coupling unit 230 of the cover 221 engaged with the cover coupling unit 210 of the body 201.

A fastening member such as, for example, a screw or the like, is inserted through the coupling hole 227 of the cover 221 and into the hinge accommodating part 155 of the ice making chamber 150 so that the cover 221 and the body 210 are fixedly combined by the same fastening member. At this time, the shaft 184 is accommodated in the partial shaft accommodating parts 203 and 223 of the body 201 and the cover 221 and rotatably supported thereby.

The mount unit 182 of the first hinge member 180 is then inserted into the hinge accommodating part 165 of the ice making chamber door 161, and a fastening member such as, for example, a screw is inserted into the coupling hole 183 of the mount unit 182 to fix the mount unit 182 in the hinge accommodating part 165, thus completing the combining operation, and rotatably the ice supporting making chamber door 161.

Figure 11:
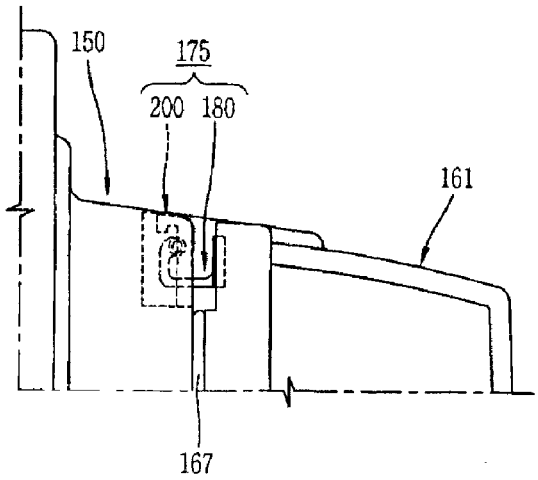
FIG. 11 is a partial plan view in which an ice making chamber door shown in FIG. 3 is closed.

When the ice making chamber door 161 is closed, as shown in FIG. 11, the second hinge member 200 and the first hinge member 180 are inserted in the corresponding hinge accommodating parts 155 and 165, respectively, and are not externally visible.

Excessive rotation of the ice making chamber door 161 may be prevented by the insertion-type hinge assembly 175. Namely, both end portions of the shaft 184 are supported by the partial shaft accommodating parts 203 and 223, and the bent portion 189 of the connection unit 187 is in contact with the connection unit accommodating part 205, while the protrusive portion 188 is in contact with the stopper 207, thus preventing the first hinge member 180 from being excessively rotated. Thus, the ice making chamber door 161 may be prevented from colliding with the front side of the ice making chamber 150.

Figure 12:
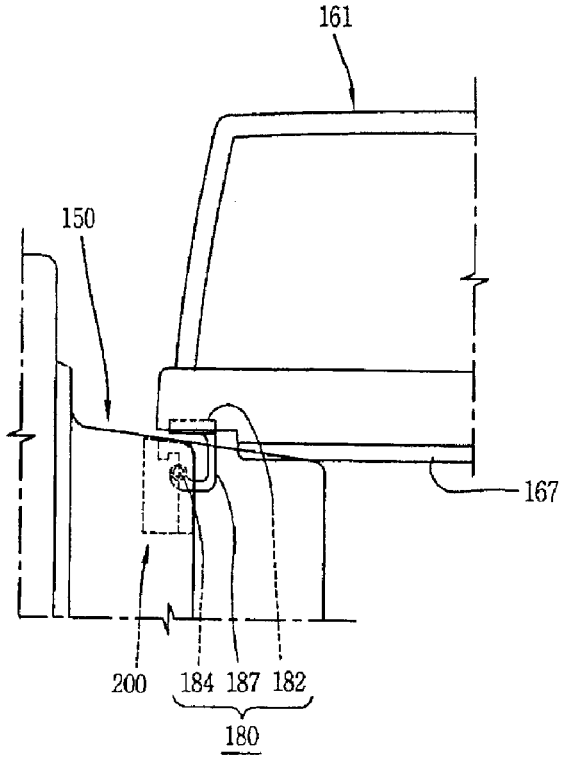
FIG. 12 is a partial plan view in which the ice making chamber shown in FIG. 11 is open.

When the ice making chamber door 161 is pulled in an opening direction, the ice making chamber door 161 is rotated about the shaft 184 and opened as shown in FIG. 12. At this time, because the connection unit 187 is in contact with one side of the penetrating portion 225 of the cover 221 and both ends of the shaft 184 are supported, excessive rotation of the ice making chamber door 161 may be prevented.

Another embodiment will now be described with reference to FIGS. 13 and 14. For the same elements and equivalents to those shown in the previous Figures and description, the same reference numerals will be used and a corresponding detailed explanation will be omitted merely for the sake of convenience.

Figure 13:
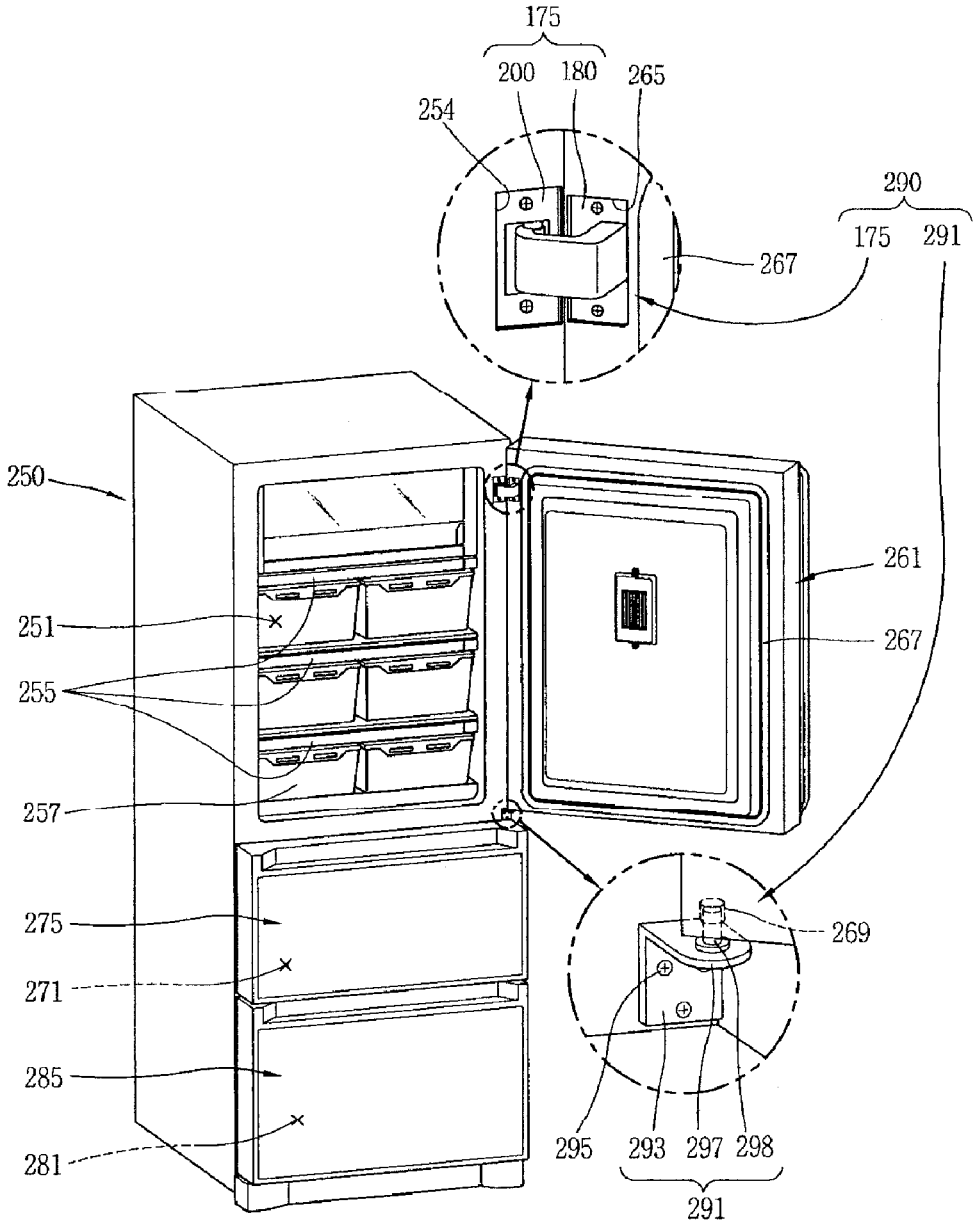
FIG. 13 is a perspective view of a refrigerator having an insertion-type hinge assembly according to another embodiment as broadly described herein.
Figure 14:
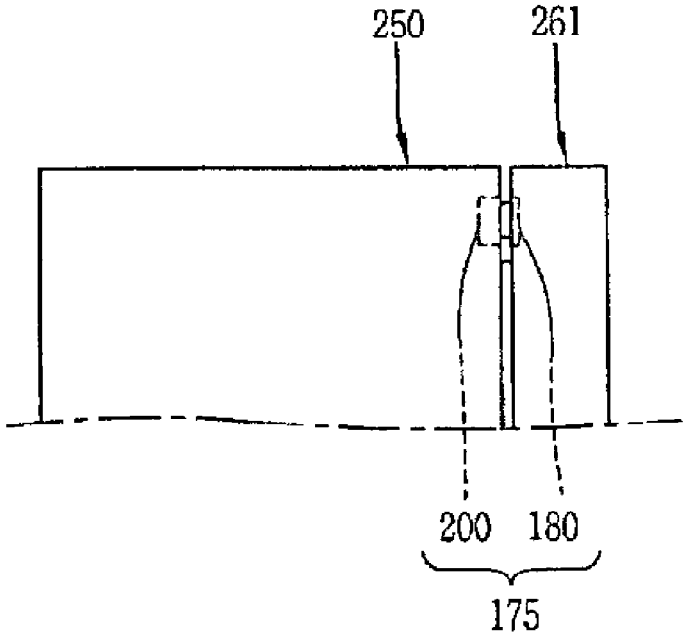
FIG. 14 is a partial side view of the refrigerator shown in FIG. 13.

As shown in FIGS. 13 and 14, a refrigerator having an insertion-type hinge assembly in accordance with another embodiment as broadly described herein may include a refrigerator main body 250 having a cooling chamber formed therein, a door for opening and closing a front opening of the cooling chamber, and a door hinge including at least one insertion-type hinge assembly installed at a mutual contact area of the door and the refrigerator main body 250 to rotatably support the door. In this embodiment, the cooling chamber may include a freezing chamber, a refrigerating chamber, and other auxiliary storage chambers such as, for example, a kimchi storage chamber, a temperature change chamber for rapidly adjusting a storage temperature therein, and/or a kimchi ripening chamber. In alternative embodiments, the refrigerator main body 250 may be configured as a kimchi refrigerator to ripen kimchi and keep the kimchi in a cold state.

As shown in FIG. 13, the refrigerator main body 250 may include a first cooling chamber 251, a second cooling chamber 271 and a third cooling chamber 281. A plurality of shelves 255 may be provided in the first cooling chamber 251, at an upper portion of the refrigerator main body 250. For example, the shelves 255 may be disposed vertically at intervals corresponding to the height of a plurality of containers 257 so that the containers 257 may be suitably accommodated. A first cooling chamber door 261 may be rotatably coupled to a front side of the first cooling chamber 251 to rotatably open and close the first cooling chamber 251.

Second and third cooling chamber doors 275 and 285 may be implemented as drawers that slide in a forward/backward direction relative to the refrigerator main body 250 to open and close the second cooling chamber 271 and the third cooling chamber 281.

A door hinge 290 may be provided at a mutual contact area of the first cooling chamber 251 and the first cooling chamber door 261 to rotatably support the first cooling chamber door 261. The door hinge 290 may include an insertion-type hinge assembly 175 provided at an upper region of the mutual contact area of the first cooling chamber 251 and the first cooling chamber door 261, and a lower hinge 291 provided at a lower region of the mutual contact area of the first cooling chamber 251 and the first cooling chamber door 261. In alternative embodiments, a plurality of insertion-type door hinges may be arranged vertically along the mutual contact area.

As described above, the insertion-type hinge assembly 175 may include the first hinge member 180 including the mount unit 182, the shaft 184 and the connection unit 187, and the second hinge member 200 including the body 201 and the cover 221.

A hinge accommodating part 254 may be formed at a front face of the first cooling chamber 251 to accommodate the second hinge member 200 therein. A hinge accommodating part 265 may be formed at an inner surface of the first cooling chamber door 261 to accommodate the mount unit 182 of the first hinge member 180 therein. A first cooling chamber door gasket 267 may be provided at an inner surface of the first cooling chamber door 261 such that it contacts the edges of the opening of the first cooling chamber 251 when the door 261 is closed against the opening to prevent leakage of cold air. The first cooling chamber door gasket 267 may be disposed at an inner side of the hinge accommodating part 265 of the first cooling chamber door 261 so that when the first cooling chamber door 261 is open or closed, the first cooling chamber door gasket 267 is not heavily pressed, and thus, deformation or damage of the first cooling chamber door gasket 267 may be prevented, and the life span, performance and reliability of the first cooling chamber door gasket 267 may be improved.

In addition, because the first hinge member 180 and the second hinge member 200 do not protrude from the refrigerator main body 250 and the first cooling chamber door 261, interference at peripheral areas of the main body 250 may be eliminated. In particular, because a hinge assembly is not mounted on the upper surface of the refrigerator main body 250, there are no obstructions on the upper surface of the refrigerator main body 250 and thus the upper surface may be utilized. In addition, the upper end of the first cooling chamber door 261 does not need to be higher than the upper end of the refrigerator main body 250 for the purpose of covering a hinge assembly that protrudes from the upper surface of the refrigerator main body 250. Rather, in this embodiment, as shown in FIG. 14, the upper end of the first cooling chamber door 261 may have substantially the same height as the upper end of the refrigerator main body 250. This allows for other components to be flush mounted at the upper end of the refrigerator main body 250 without obstructing operation of any of the doors.

The lower hinge 291 may include a fixed unit 293 having vertical surface contact with the front side of the refrigerator main body 250 and fixed thereto by a plurality of fasteners 295, a support unit 297 bent at a right angle from an upper end of the fixed unit 293 and protruding forward horizontally therefrom, and a hinge pin 298 that protrudes upward from an upper surface of the support unit 297. The hinge pin 298 may be inserted into a hinge pin hole 269 formed in a lower end of the first cooling chamber door 261 such that the hinge pin 298 is able to rotate within the hinge pin hole 269. The lower hinge 291 is configured to substantially support the load of the first cooling chamber door 261.

When so configured, the shaft 184 of the first hinge member 180 passes through the penetrating portion 225 of the cover 221 of the second hinge member 200, and the body 201 and the cover 221 of the second hinge member 200 are combined. Thereafter, the second hinge member 200 is positioned in the hinge accommodating part 254 of the refrigerator main body 250 and fixed therein by a fastening member such as, for example, a screw or the like. The fixed unit 293 of the lower hinge 291 is fixed to the refrigerator main body 250, and the hinge pin 298 of the lower hinge 291 is inserted into the hinge pin hole 269 formed at the lower end of the first cooling chamber door 261 so as to rotatably support the first cooling chamber door 261.

After the lower end of the first cooling chamber door 261 is supported by the lower hinge 291, the mount unit 182 of the first hinge member 180 is inserted into the hinge accommodating part 265 of the first cooling chamber door 261. By fixing the mount unit 182 of the first hinge member 180 with a fastening member such as, for example, a screw or the like, the coupling operation is completed. As for the coupling order, the lower hinge 291 may be mounted at the refrigerator main body 250 and the first cooling chamber door 261 may be combined to the lower hinge 291 to support the lower end of the first cooling chamber door 261, and then the insertion-type hinge assembly 175 may be combined to the upper portion.

By coupling the insertion-type hinge assembly 175 to the first cooling chamber door 261 and the first cooling chamber 251, interference with the periphery of the refrigerator may be prevented. In addition, the insertion-type hinge assembly 175 may be installed at the front side, and not the upper end, of the refrigerator main body 250, so that the upper end surface of the refrigerator main body 250 may be utilized. In particular, a hinge assembly does not protrude from the upper end of the refrigerator main body 250, and the height of the first cooling chamber door 261 may be the same as or lower than the upper end of the refrigerator main body 250. Thus, the material cost of the first cooling chamber door 261 may be reduced and the size and weight of the first cooling chamber door 261 may also be reduced.

Another embodiment will now be described with reference to FIGS. 15 to 17.

Figure 15:
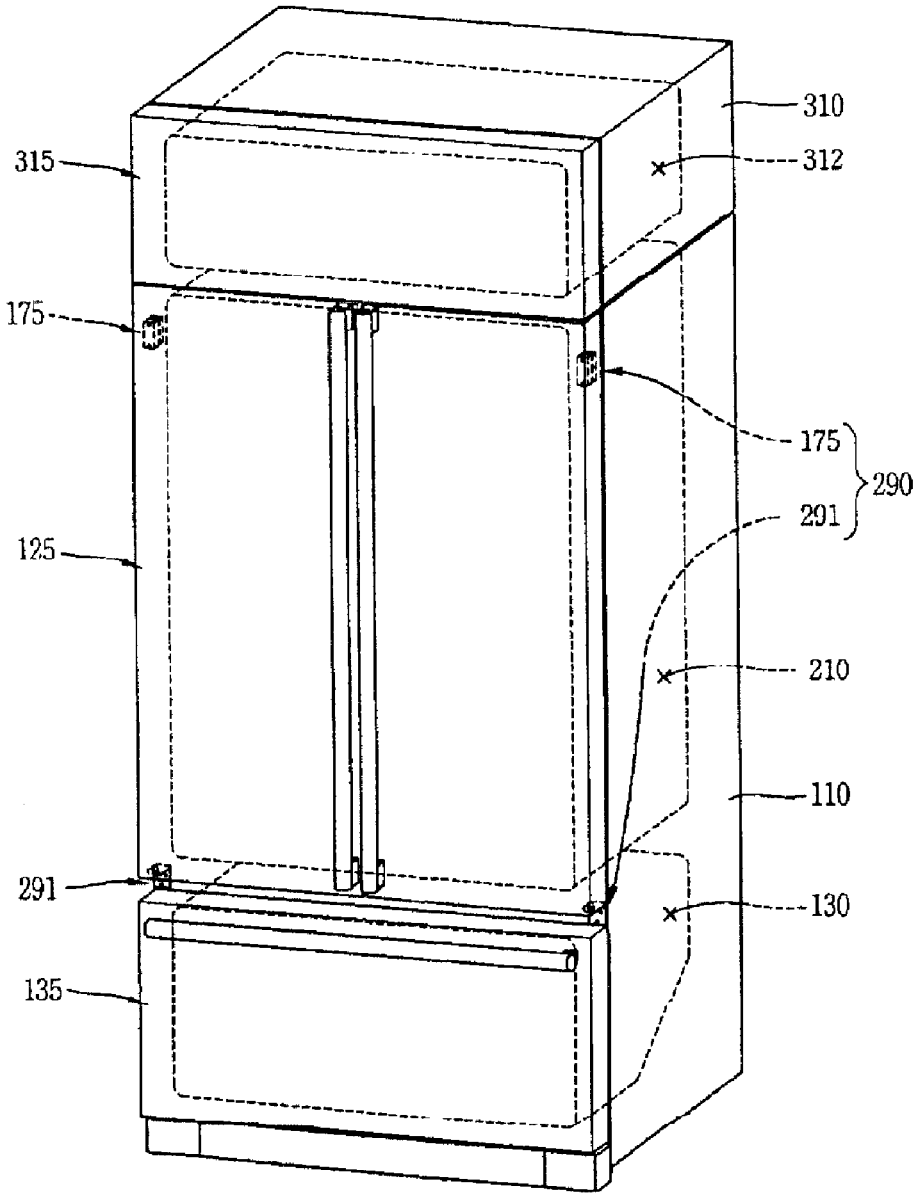
FIG. 15 is a perspective view of a refrigerator having an insertion-type hinge assembly according to another embodiment as broadly described herein.
Figure 16:
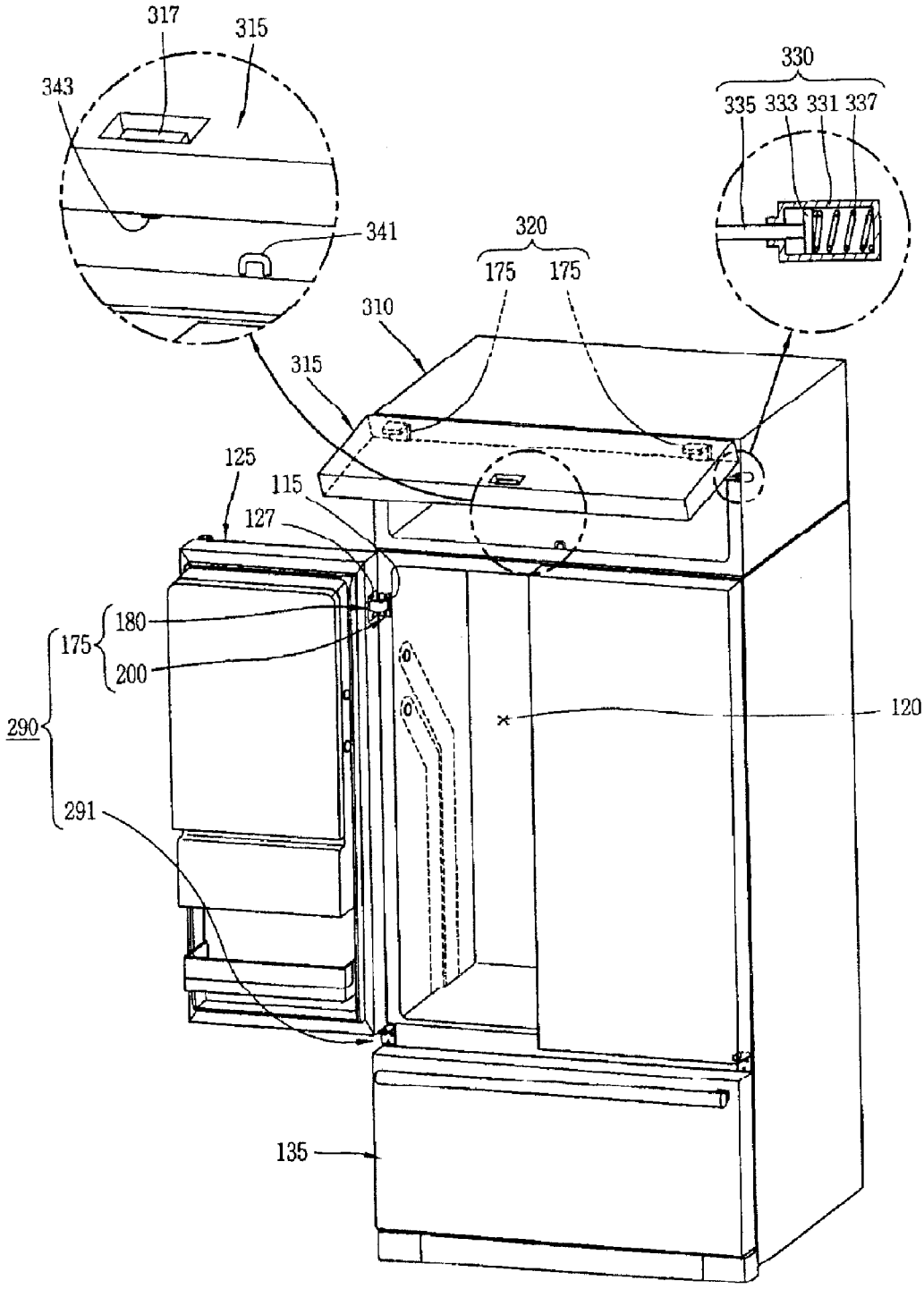
FIG. 16 illustrates an open state of a refrigerator chamber door and a reservoir door shown in FIG. 15.
Figure 17:
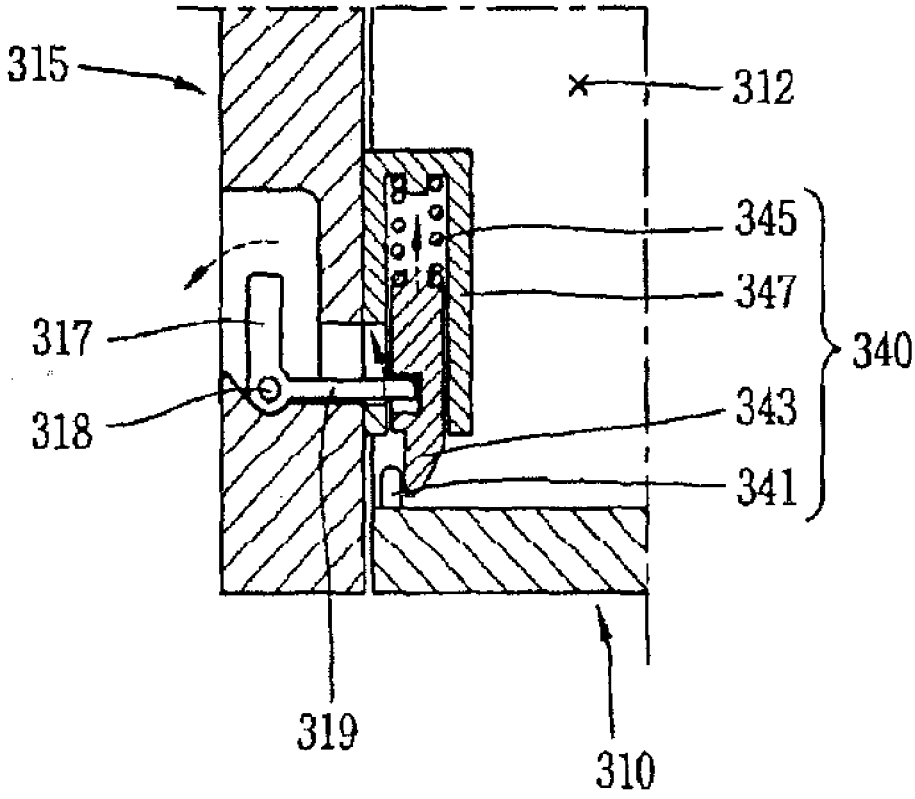
FIG. 17 is a sectional view of a locking unit region shown in FIG. 16.

As shown in FIGS. 15 to 17, a refrigerator having an insertion-type hinge assembly as embodied and broadly described herein may include a refrigerator main body 110 having a cooling chamber formed therein, a door for opening and closing a front opening of the cooling chamber, a door hinge 290 including an insertion-type hinge assembly 175 provided at an upper region of a front side of the cooling chamber to rotatably support the door, a reservoir 310, or cabinet, at an upper end of the refrigerator main body 110 that forms a storage space 312 having an open front side, and a reservoir door 315 for opening and closing the opening of the reservoir 310.

A refrigerating chamber 120 may be formed at an upper region of the refrigerator main body 110, and a freezing chamber 130 may be formed at a lower region of the refrigerator main body 110. The freezing chamber 130 may include a drawer-type freezing chamber door 135. The refrigerating chamber 120 may be opened/closed by a pair of refrigerating chamber doors 125 each including an insertion-type hinge assembly 175 and each rotatably supported by a door hinge 290. As described above with reference to FIGS. 13 and 14, the door hinge 290 may include an insertion-type hinge assembly 175 at an upper portion of the refrigerating chamber door 125 and a lower hinge 291 supporting the lower end of the refrigerating chamber door 125.

Regarding the insertion-type hinge assembly 175, the first hinge member 180 may be inserted into and coupled to a hinge accommodating part 254 formed at an upper region of one side of the refrigerating chamber door 125, and the second hinge member 200 may be inserted into and coupled to a hinge accommodating part 115 formed at an upper region of a front side of the refrigerator main body 110. Accordingly, the refrigerator doors 125 may have substantially the same height as the upper end of the refrigerator main body 110. Alternatively, the height of the upper end of the refrigerating chamber door 125 may be slightly lower than the upper end of the refrigerator main body 110. Thus, because the height of the refrigerating chamber doors 125 is reduced, fabrication costs and weight can be reduced, and the space at the upper surface of the main body 110 may be utilized.

The reservoir 310 with a storage space 312 formed therein may be provided at the upper end of the refrigerator main body 110. The reservoir 310 may have a rectangular parallelepiped shape, as shown in FIG. 15, or other shape as appropriate. A horizontal width of the reservoir 310 may correspond to that of the refrigerator main body 110, and the reservoir 310 may have a height allowing an upper surface of the reservoir 310 to be in contact with the ceiling of a room, such as, for example, a kitchen, in which the refrigerator is installed.

Because there is no protrusion on the upper surface of the refrigerator main body 110, no interference occurs when the reservoir 310 is installed on top of the main body 110, and a hinge accommodating part does not need to be formed at the reservoir 310 to accommodate such a hinge assembly. Thus, the reservoir 310 may be quickly and easily installed, and may provide an integral appearance, improving the quality of the external appearance. In this embodiment, the depth of the reservoir 310 in the forward/backward direction may be substantially the same as the depth of the refrigerator main body 110 in the forward/backward direction, but the depth of the reservoir 310 may also be less than that of the refrigerator main body 110.

A reservoir door hinge 320 may be provided between a front surface of the reservoir 310 and a contact surface of the reservoir door 315 to rotatably support the reservoir door 315. The reservoir door hinge 320 may include insertion-type hinge assemblies 175 inserted into and coupled to the reservoir 310 and the reservoir door 315. Accordingly, the insertion-type hinge assemblies 175 do not protrude, so there is no interference at the periphery. In addition, because a hinge assembly is not installed at the upper surface of the reservoir 310, the upper surface of the reservoir 310 can be in contact with the ceiling of the installation space. Thus, the refrigerator can be quickly and easily installed without a gap between the upper surface of the reservoir 310 and the ceiling.

The insertion-type hinge assembly 175 may be installed at opposite end regions of upper edges of the front opening of the reservoir 310. In this case, the shafts 184 of the insertion-type hinge assemblies 175 may be disposed along a horizontal direction. The reservoir door 315 may thus be rotated upwardly based on this horizontal orientation of the shafts 184. Accordingly, the reservoir door 315 may be easily open and closed, without interference with the refrigerating chamber door 125.

The reservoir 310 and the reservoir door 315 may also include a support unit 330 to support the reservoir door 315 when the reservoir door 315 is open. The support unit 330 may include a cylinder mechanism including a cylinder 331, a piston 333 that reciprocates within the cylinder 331, and a piston rod 335 connected to the piston 333 in a lengthwise direction. The support unit 330 may operate under air pressure or oil pressure. The support unit 330 may open and close the reservoir door 315, and when the reservoir door 315 is open, the support unit 330 maintains the open state of the reservoir door 315.

The support unit 330 may include a spring 337 for providing elasticity to the piston 333 in a longitudinal direction. The spring 337 may be compressed to accumulate elasticity when the reservoir door 315 is closed. In addition, the characteristics (e.g., the length, the coil diameter, modulus of elasticity, and the like) and number of the springs 337 may be suitably adjusted based on a degree at which the spring(s) can support an open state of the reservoir door 315, or a degree at which the spring(s) can be easily contracted when the reservoir door 315 is pressed. Accordingly, because the reservoir door 315 is open by virtue of the elasticity of the spring 337, it may be easily opened. In addition, the reservoir door 315 may be maintained in the open state by being elastically supported by the spring 337.

The reservoir 310 and the reservoir door 315 may include a locking unit 340 that prevents the reservoir door 315 from opening when the reservoir door 315 is closed. The locking unit 340 may include a stop portion 341, and a hook 343 which is elastically moved with respect to the stop portion 341 so as to be hooked or released. The hook 343 may be elastically supported by a spring 345. The stop portion 341 may be installed at one of the reservoir 310 or the reservoir door 315, and the hook 343 may be installed at the other. For example, the stop portion 341 may protrude upward from an inner front region of the lower surface of the reservoir 310, and the hook 343 may protrude downward from the inner surface of the reservoir door 315 and may be moved up and down, as shown in FIG. 17. The spring 345 may be provided at one end of the hook 343 to provide elasticity that forces the hook 343 down. The hook 343 and the spring 345 may be installed within a housing 347 provided on a rear surface of the reservoir door 315.

The hook 343 may interact with a handle 317 rotatably provided at a front surface of the reservoir door 315. The handle 317 may rotate about a rotational shaft 318, and a lever 319 may extend back from a rear side of the handle 317. The lever 319 is connected with the hook 343, so that when the handle 317 is rotated forward, the lever 319 is cooperatively rotated upward to move the hook 343 up. The spring 345 is then pressed and contracted by the hook 343, accumulating elasticity. When the handle 317 is released, the hook 343 is restored downward due to the elasticity of the spring 345 and the handle 317 is returned to its initial position.

When so configured, the refrigerating chamber door 125 is coupled to the front side of the refrigerator body 110 by the insertion-type hinge assembly 175, and the upper end of the refrigerating chamber door 125 may be level with or lower than the upper end of the refrigerator body 110. Accordingly, the reservoir 310 may be installed at the upper end of the refrigerator body 110 without any interference.

The reservoir door 315 may be installed at the front side of the reservoir 310 such that it rotates in a vertical direction, and the refrigerating chamber door 125 and the reservoir door 315 may freely open and close without interference therebetween.

When the handle 317 of the reservoir door 315 is pulled, the hook 343 may be moved up and released, thus extending the support unit 330 due to the elasticity of the spring 337, and pressing the reservoir door 315 outwardly to open the front opening of the reservoir 310. The support unit 330 supports the reservoir door 315 in the open state.

When the reservoir door 315 is closed, the support unit 330 is compressed. Immediately before the reservoir door 315 is completely closed, the hook 343 is in contact with the stop portion 341 and moved up, and when the reservoir door 315 completely closes the front opening of the reservoir 310, the hook 343 protrudes downward due to the elasticity of the spring 345. At this time, the hook 343 disposed at the rear side of the stop portion 341 prevents the reservoir door 315 from opening.

Because one of the first or second hinge members is insertedly installed on the front side of the cooling chamber, the ice making chamber, and the storage chamber, and another is insertedly installed at the ice making chamber door or the storage chamber door, interference with peripheral components may be prevented. Thus, the hinge does not from the upper end of the refrigerator main body, and the upper end surface of the refrigerator main body may be utilized.

In addition, the door does not need to be higher than the upper end of the refrigerator to visually a hinge assembly protruding from the upper end of the refrigerator main body. Thus, the fabrication costs of the door may be reduced and the weight of the door may be reduced.

A storage chamber can be formed at the upper end of the refrigerator main body, so the space can be utilized.

Moreover, the first and second hinge members are not exposed when the respective doors are closed, interference at periphery is avoided, an integral appearance is obtained, and thus the quality of external appearance may be improved.

Furthermore, when the respective doors are open or closed, various door gaskets provided at the respective doors are not heavily pressed, so the door gaskets are not deformed and damaged.

A hinge assembly installed at a front side of a target, and a refrigerator having the same are provided.

A hinge assembly which is restrained in its exposure to thus prevent an interference with peripheral components, and a refrigerator having the same, are provided.

A hinge assembly capable of restraining a gasket from being damaged, and a refrigerator having the same, are provided.

An insertion-type hinge assembly as embodied and broadly described herein may include a first hinge member including a mount unit that can be fixed to a target and a shaft separated from the mount unit and disposed to be parallel to the mount unit; and a second hinge member combined such that the shaft is accommodated therein, and being rotatable relatively based on the shaft, wherein the first and second hinge members are insertedly installed in corresponding targets such that their exposure is restrained.

The first hinge member may include a connection unit protruded from the mount unit and having an end portion bent to be connected with the shaft.

The second hinge member may include a body having a partial shaft accommodating part in which the shaft is partially accommodated, and a cover having a partial shaft accommodating part in which the shaft is partially accommodated, the body and the cover accommodating the shaft cooperatively.

The protrusion of the connection unit may be formed to be protruded from one edge portion of the mount unit.

A stopper may be formed at the body to be in contact with the connection unit to restrain a relative rotation of the connection unit.

An insertion-type hinge assembly as embodied and broadly described herein may include a refrigerator main body having a cooling chamber formed therein; a door for opening and closing a front opening of the cooling chamber; and a door hinge including at least one insertion-type hinge assembly to rotatably support the door.

The insertion-type hinge assembly may be disposed at an upper region of one edge portion of the door.

A hinge accommodating part may be formed at a contact area where the door and the refrigerator main body are in contact with each other such that the insertion-type hinge assembly is inserted.

The ice making chamber door may include an ice making chamber door gasket such that the ice making chamber door is disposed at an inner side of the insertion-type hinge assembly.

An insertion-type hinge assembly as embodied and broadly described herein may include a refrigerator main body having a cooling chamber formed therein; a door for opening and closing a front opening of the cooling chamber; an ice making chamber formed at one of the refrigerator main body and the door; an ice making chamber door for opening and closing the opening of the ice making chamber; and an ice making chamber door hinge including at least one insertion-type hinge assembly to rotatably support the ice making chamber door.

The insertion-type hinge assembly may be disposed at an upper region of one edge portion of the ice making chamber door.

The insertion-type hinge assembly may be displayed at upper and lower portions of one side of the ice making chamber door.

A hinge accommodating part may be formed at the side wall of the ice making chamber and at a mutual contact area of the ice making chamber door, such that the insertion-type hinge assemblies may be accommodated, respectively.

The refrigerator may also include a door hinge including at least one insertion-type hinge assembly to rotatably support the door with respect to the refrigerator main body.

The insertion-type hinge assembly of the door hinge may be disposed at an upper region of one edge portion of the door.

A hinge accommodating part may be formed at the refrigerator main body and at the door to accommodate the insertion-type hinge assembly, respectively.

An insertion-type hinge assembly as embodied and broadly described herein may include a refrigerator main body having a cooling chamber formed therein; a door for opening and closing a front opening of the cooling chamber; a door hinge including an insertion-type hinge assembly combined to an upper region of a front surface of the side wall of the cooling chamber to rotatably support the door; a reservoir forming a storage space with a front side opened, and disposed at an upper end of the refrigerator main body; and a reservoir door for opening and closing of the opening of the reservoir.

The refrigerator may also include a reservoir door hinge including the insertion-type hinge assembly to rotatably support the reservoir door.

The reservoir door hinges may be combined at an upper portion of a front side of the reservoir such that their axial lines are horizontally disposed.

The reservoir and the reservoir door may include a hinge accommodating part for accommodating the insertion-type hinge assembly, respectively.

As mentioned above, because one of the first and second hinge members is insertedly installed on the front side of the cooling chamber, the ice making chamber, and the storage chamber, and another is insertedly installed at the ice making chamber door or the storage chamber door, an interference with peripheral components may be prevented. Thus, the hinge may be prevented from being protruded from the upper end of the refrigerator main body, and thus, the upper end surface of the refrigerator main body may be utilized.

In addition, the door does not need to be higher than the upper end of the refrigerator to visually prevent a hinge (assembly) protruded from the upper end of the refrigerator main body. Thus, the fabrication costs of the door may be reduced and the weight of the door can be reduced.

The storage chamber can be formed at the upper end of the refrigerator main body, so the space may be utilized.

Moreover, the first and second hinge members are prevented from being exposed when the respective doors are closed, an interference with periphery cannot be generated, an integral sense may be obtained, and the quality of external appearance may be improved.

Furthermore, when the respective doors are open or closed, various door gaskets provided at the respective doors can be prevented from being heavily pressed, so the door gaskets may be prevented from being deformed and damaged.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An insertion-type hinge assembly, comprising:
- a first hinge member, including:
  - a mount portion configured be fixed to a first recess; and
  - a shaft coupled to and separated from the mount portion and disposed in parallel to the mount portion; and
- a second hinge member, including:
  - a body portion configured to be fixed to a second recess, wherein the second hinge member receives the shaft therein so as to rotatably couple the first and second hinge members;
  - a cover coupled to the body portion; and
  - a cover coupling unit formed at one side of the body portion, wherein the cover is engaged in the cover coupling unit so as to couple the cover to the body portion, wherein the cover coupling unit comprises:
    - a recess formed along a longitudinal edge of the body portion; and
    - a stop protrusion that protrudes from the recess wherein the body portion of the second hinge member comprises a partial shaft accommodating part in which a first longitudinal portion of the shaft is received, and wherein the cover includes a partial shaft accommodating part in which a second longitudinal portion of the shaft is received, such that the body portion and the cover fully accommodate the shaft when the body portion and the cover are coupled with the shaft positioned therebetween.

2. The hinge assembly of claim 1, wherein the first hinge member comprises a connection portion that extends outward from the mount portion, the connection portion having a bent end portion formed at a distal end thereof that is coupled to the shaft.

3. The hinge assembly of claim 2, wherein the mount portion comprises a plate shaped member that is configured to be fixed within the first recess, and the body portion comprises a block shaped member that is configured to be fixed within the second recess, and wherein the connection portion extends outward from the mount portion and into the body portion so as to position the bent end portion and shaft coupled thereto within the body portion.

4. The hinge assembly of claim 2, further comprising a stopper formed on the body portion of the second hinge member so as to selectively contact the connection portion of the first hinge member and limit a degree of rotation of the connection portion as the first hinge member rotates relative to the second hinge member.

5. A refrigerator comprising the insertion-type hinge assembly of claim 1.

6. A refrigerator having an insertion-type hinge assembly, comprising:
- a main body having a cooling chamber formed therein;
- a main door that opens and closes a front opening of the cooling chamber; and
- at least one first hinge assembly that rotatably couples the main door to the main body, comprising:
  - a first hinge member, including:
    - a mount portion installed in a first recess; and
    - a shaft coupled to and separated from the mount portion; and
  - a second hinge member, including:
    - a body portion installed in a second recess positioned opposite the first recess, wherein the second hinge member receives the shaft therein so as to rotatably couple the first and second hinge members;
    - a cover configured to be coupled to the body portion; and
    - a cover coupling unit formed at one side of the body portion, wherein the covet is engaged in the cover coupling unit so as to couple the cover to the body portion, wherein the cover coupling unit comprises:
      - a recess formed along a longitudinal edge of the body portion; and
      - a stop protrusion that protrudes from the recess wherein the body portion of the second hinge member comprises a partial shaft accommodating part in which a first longitudinal portion of the shaft is received, and wherein the cover includes a partial shaft accommodating part in which a second longitudinal portion of the shaft is received, such that the body portion and the cover fully accommodate the shaft when the body portion and the cover are coupled with the shaft positioned therebetween.

7. The refrigerator of claim 6, wherein the first recess is formed in one of the main door or the main body, and the second recess is formed in the other of the main door or the main body.

8. The refrigerator of claim 7, wherein profiles of the first and second hinge members are contained within respective peripheries of the main body and the door.

9. The refrigerator of claim 6, wherein the at least one hinge assembly is installed at an upper region of one edge portion of the main door.

10. The refrigerator of claim 6, further comprising:
- an ice making chamber provided on an interior side of the main door;
- an auxiliary door that opens and closes an open face of the ice making chamber; and
- at least one second hinge assembly that rotatably couples an edge of the auxiliary door to the ice making chamber provided on the main door.

11. The refrigerator of claim 10, further comprising a gasket positioned on the auxiliary door, at an inner side of the at least one second hinge assembly, so as to form a seal between the ice making chamber and the auxiliary door when the auxiliary door is closed against the ice making chamber.

12. The refrigerator of claim 11, wherein profiles of the first and second hinge members are contained within respective peripheries of the main body and the main door, and a profile of the at least one second hinge assembly is contained within respective peripheries of the ice making chamber and the auxiliary door.

13. The refrigerator of claim 10, wherein the at least one second hinge assembly comprises a pair of second hinge assemblies respectively provided at upper and lower portions of one edge of the auxiliary door.

14. The refrigerator of claim 10, wherein the at least one second hinge assembly comprises a third hinge member received in a third recess formed in one of a side wall of the ice making chamber or the auxiliary door, and a fourth hinge member received in a fourth recess formed in the other of the side wall of the ice making chamber or the auxiliary door.

15. The refrigerator of claim 10, further comprising:

a supplementary body coupled to the main body such that a bottom surface of the supplementary body is flush with a top surface of the main body, the supplementary body having a supplementary storage space formed therein;

a supplementary door that opens and closes an open face of the supplementary body; and at least one third hinge assembly that rotatably couples an upper edge of the supplementary door to the supplementary body such that the supplementary door and the main door rotate relative to the supplementary body and the main body, respectively, without interference therebetween.

16. The refrigerator of claim 15, wherein the at least one third hinge assembly comprises a fifth hinge member received in a fifth recess formed in one of a front face of the supplementary body or the upper edge of the supplementary door, and a sixth hinge member received in a sixth recess formed in the other of the front face of the supplementary body or the upper edge of the supplementary door.

* * * * *